US006377914B1

(12) United States Patent
Yeldener

(10) Patent No.: US 6,377,914 B1
(45) Date of Patent: Apr. 23, 2002

(54) EFFICIENT QUANTIZATION OF SPEECH SPECTRAL AMPLITUDES BASED ON OPTIMAL INTERPOLATION TECHNIQUE

(75) Inventor: Suat Yeldener, Germantown, MD (US)

(73) Assignee: Comsat Corporation, Bethesda, MD (US)

( * ) Notice: Subject to any disclaimer, the term of this patent is extended or adjusted under 35 U.S.C. 154(b) by 0 days.

(21) Appl. No.: 09/266,839

(22) Filed: Mar. 12, 1999

(51) Int. Cl.[7] ..... G10L 19/02; G10L 11/04
(52) U.S. Cl. ..... 704/205; 704/207; 704/230
(58) Field of Search ..... 704/205, 207, 704/222, 230

(56) References Cited

U.S. PATENT DOCUMENTS 5,495,555 A 2/1996 Swaminathan
5,504,833 A 4/1996 George et al.
5,577,159 A 11/1996 Shoham
5,583,888 A 12/1996 Ono
5,623,575 A 4/1997 Fette et al.
5,630,011 A * 5/1997 Lim et al. ..... 704/205
5,809,455 A 9/1998 Nishuguchi et al.
5,832,437 A * 11/1998 Nishiguchi et al. ..... 704/268
6,018,707 A * 1/2000 Nishiguchi et al. ..... 704/222

* cited by examiner

*Primary Examiner*—Tālivaldis Ivars Ŝmits
(74) *Attorney, Agent, or Firm*—Sughrue Mion, PLLC

(57) ABSTRACT

A speech coding algorithm interpolates groups speech frames into speech frame pairs, and quantizes each frame of the pair according to a different algorithm. The spectral amplitudes of the second frame are quantized by dividing them into two portions and quantizing one portion and then quantizing a difference between the two portions. The spectral amplitudes of the first frame of the pair are quantized by first converting to a fixed dimension, then interpolating between previous and subsequent frames, then selecting interpolated values in accordance with a mean squared error approach.

14 Claims, 2 Drawing Sheets

EFFICIENT QUANTIZATION OF SPEECH SPECTRAL AMPLITUDES BASED ON OPTIMAL INTERPOLATION TECHNIQUE

BACKGROUND OF THE INVENTION

The present invention is directed to low bit rate (4.8 kb/s and below) speech coding, and particularly to a robust and efficient quantization scheme for use in such coding.

The number of harmonic magnitudes that must be quantized and transmitted for a given speech frame is a function of the estimated pitch period. This figure can vary from 8 harmonics in the case of high pitched speaker to as much as 80 for an extremely low pitched speaker. For the ITU 4 kb/s toll quality speech coding algorithm, there are only 80 bits available to quantize the whole speech model parameters (LSF coefficients, Pitch, Voicing information, and Spectral Amplitudes or Harmonic Magnitudes). For this purpose, only 21 bits are available to quantize 2 sets of spectral amplitudes (2 frames). Straightforward quantization schemes do not provide enough degree of transmission efficiency with the desired performance. Efficient quantization of the variable dimension spectral vectors is a crucial issue in low bit rate harmonic speech coders.

Recently, several techniques have been developed for the quantization of variable dimension spectral vectors. In R. J. McAulay and T. F. Quatieri "Sinusoidal Coding", in Speech Coding and Synthesis (W. B. Kleijn and K. K. Paliwal, edts.), Amsterdam, Elsevier Science Publishers, 1995, and S. Yeldener, A. M. Kondoz, B. G. Evans "Multi-Band Linear Predictive Speech Coding at Very Low Bit Rates" IEEE Proc. Vis. Image and Signal Processing, October 1994, Vol. 141, No. 5, pp. 289–295, an all-pole (LP) model is used to approximate the spectral envelope using a fixed number of parameters. These parameters can be quantized using fixed dimension Vector Quantization (VQ). In Band Limited Interpolation (BLI), e.g., described by M. Nishignchi, J. Matsumoto, R. Walcatsuld and S. Ono "Vector Quantized MBE with simplified V/LV decision at 3 Kb/s", Proc. of ICASSP-93, pp. II-151-154, the variable dimension vectors are converted into fixed dimension vectors by sampling rate conversion which preserves the shape of the spectral envelope. The concept of spectral bins for the dimension conversion is employed in variable dimension vector quantization (VDVQ), described by A. Das, A. V. Rao, A. Gersho "Variable Dimension Vector Quantization of Speech Spectra for Low Rate Vocoders" Proc. of Data Compression Conf. Pp. 421–429, 1994. In VDVQ, the spectral axis is divided into segments, or bins and each spectral sample is mapped onto the closest spectral bin to form a fixed dimension vector for quantization. A truncation method (P. Hedelin "A tone oriented voice excited vocoder" Proc. of ICASSP-81, pp. 205–208, and a zero padding method (E. Shlomot, V. Cuperman and A. Gersho "Combined Harmonic and Waveform Coding of Speech at Low Bit Rates" Proc. ICASSP-98, pp. 585–588) convert the variable dimension vector to a fixed dimension vector by simply truncating or zero padding, respectively. Another method for the quantization of the spectral amplitudes is the linear dimension conversion which is called non-square transform VQ (NSTVQ), described by P. Lupini, V. Cuperman "Vector Quantization of harmonic magnitudes for low rate speech coders" Proc. IEEE Globecorn, 1994.

All of these schemes mentioned above are not very efficient methods to quantize the spectral amplitudes with a minimal distortion using only a few bits.

SUMMARY OF THE INVENTION

It is an object of the invention to provide an improved method of quantizing spectral amplitudes, to provide a higher degree of transmission efficiency and performance.

In accordance with this invention, two consecutive frames are grouped and quantized together. The spectral amplitude gain for the second sub-frame is quantized using a 5-bit non-uniform scalar quantizer. Next, the shape of the spectral harmonic amplitudes are split into odd and even harmonic amplitude vectors. The odd vector is converted to LOG and then DCT domain, and then quantized using 8 bits. The even vector is converted to LOG and then used to generate a difference vector relative to the quantized odd LOG vector and the difference vector, and this difference vector is then quantized using 5 bits. Since the vector quantizations for spectral amplitudes can be done in the DCT domain, a weighting can be used that gives more emphasis to the low order DCT coefficients than the higher order ones. In the end, a total of 18 bits are used for spectral amplitudes of the second frame.

The spectral amplitudes for the first frame are quantized based on optimal linear interpolation techniques using the spectral amplitudes of the previous and next frames. Since the spectral amplitudes have variable dimension from one frame to the next, an interpolation algorithm is used to convert variable dimension spectral amplitudes into a fixed dimension. Further interpolation between the spectral amplitude values of the previous and next frames yields multiple sets of interpolated values, and comparison of these to the original interpolated (i.e., fixed dimension) spectral amplitude values for the current frame yields an error signal. The best interpolated spectral amplitudes are then chosen in accordance with a mean squared error (MSE) approach, and the chosen amplitude values (or an index representing the same) are quantized using three bits.

BRIEF DESCRIPTION OF THE DRAWING

The invention will be more clearly understood from the following description in conjunction with the accompanying drawing, wherein.

DETAILED DESCRIPTION OF THE INVENTION

Figure 1:
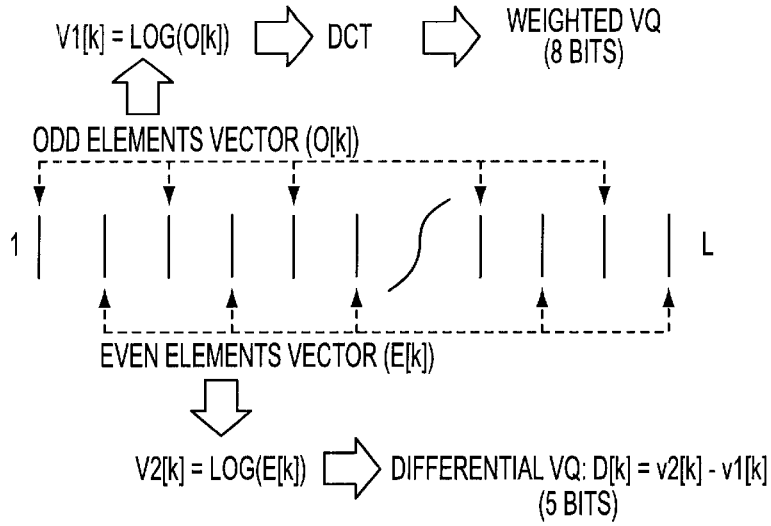
FIG. 1 is an illustration of the quantization scheme for the second subframe in the method according to the present invention.

In order to increase efficiency in the spectral amplitude quantization scheme, two consecutive frames are grouped and quantized together. First, the spectral amplitude gain for the second sub-frame is quantized using a 5-bit non-uniform scalar quantizer. Next, the shape of the spectral harmonic amplitudes are split into odd and even harmonic amplitude vectors O[k] and E[k], respectively, as shown in FIG. 1. The shape of the odd harmonic amplitude vector is converted into the LOG domain as a vector V1[k], then converted to the DCT domain, and is then quantized using 8 bits. The shape of the even harmonic amplitude vector is converted into the LOG domain as a vector V2[k]. The quantized odd harmonic amplitude vector is subjected to inverse DCT to obtain a quantized log vector, and an error (or differential vector) D[k]=v2[k]−v1[k] is then calculated between this quantized odd harmonic amplitude vector and the original even harmonic amplitude vector. This error vector D[k] is then vector quantized using only 5 bits. If desired, the difference vector can be converted to the DCT domain before quantization.

Since the vector quantizations for spectral amplitudes can be done in the DCT domain, a weighting is used that gives more emphasis to the low order DCT coefficients than the higher order ones. In the end, a total of 18 bits are used for spectral amplitudes of the second frame.

Figure 2:
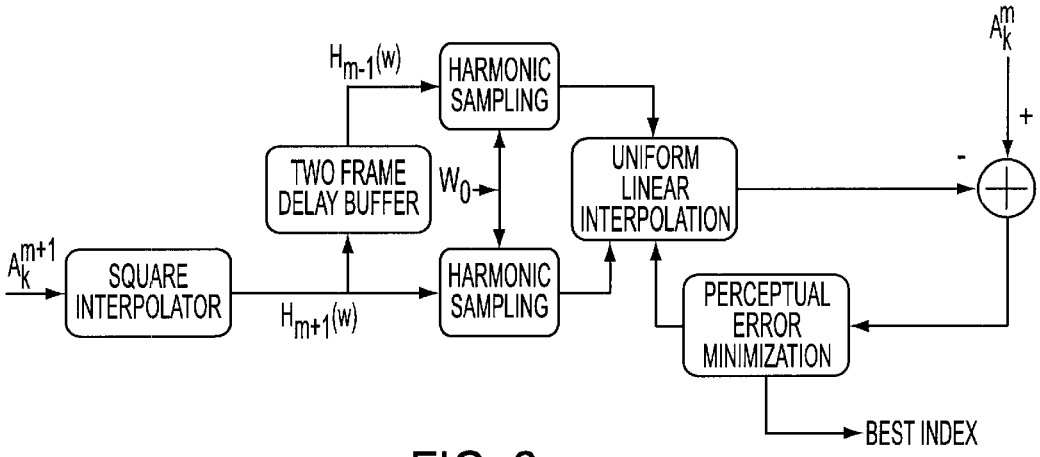
FIG. 2 is a diagram illustrating the optimal interpolation technique according to the present invention.

The spectral amplitudes for the first frame are quantized based on optimal linear interpolation techniques using the spectral amplitudes of the previous and next frames. Since the spectral amplitudes have variable dimension from one frame to the next, an interpolation algorithm is used to convert variable dimension spectral amplitudes ($A_k$'s) into a fixed dimension ($H(\omega)$). The block diagram of this scheme is illustrated in FIG. 2.

This can also be formulated as follows:

$$H(\omega) = A_k; \quad \left(\omega_k - \frac{\omega_0}{2}\right) \le \omega < \left(\omega_k + \frac{\omega_0}{2}\right) \tag{1}$$

where $1 \leqq k \leqq L$; L is the total number of harmonics within 4 kHz speech band, $A_k$ and $\omega_k$ are the $k^{th}$ harmonic magnitude and frequency respectively, $\omega_o$, is the fundamental frequency of the corresponding speech frame and $H(\omega)$ is the interpolated spectral amplitudes for the entire speech spectrum. In this way, the frame is represented by a set of amplitude values such that the amplitude value is fixed/constant over each discrete range in Equation (1). This Equation (1) is implemented in FIG. 2 by the square interpolator.

The next step is to compare the original interpolated spectral amplitudes with the neighboring interpolated amplitudes sampled at the harmonics of the fundamental frequency to find the similarity measure of the neighboring spectral amplitudes. Thus, the spectral amplitudes are passed through a two-frame delay buffer, with the amplitude values for the previous frame going to the upper harmonic sampler and the amplitude values from the next frame going to the lower harmonic sampler. In each case, the amplitude values are sampled at the fundamental frequency $\omega_0$ of the present frame, i.e., the first frame in the two-frame pair being processed. This will yield sets of linearly interpolated spectral amplitude values $H_m(k\omega_0,n)$. An optimal set of values is selected in the Uniform Linear Interpolation, and this selected set is then compared to the original interpolated spectral amplitude values (i.e., the fixed dimension values at the output of the square interpolator). In order to obtain the best performance, an attempt is made to minimize the Mean Squared Error (MSE) in the Perceptual Error Minimization, $$E_n = \sum_{k=0}^{L} [A_k^m - H_m(k\omega_0, n)]^2 W(k) \tag{2}$$

where $A_k$ is the $k^{th}$ original harmonic spectral amplitude for the $m^{th}$ frame, $H_m(k\omega_0,n)$ are the spectral amplitudes that are linearly interpolated at index n between the adjacent frames and then sampled at the harmonics of the current frame's fundamental frequency, and W(k) is the weighting function that gives more emphasis to low frequency harmonics than the higher ones. The function, $H_m(k\omega_0, n)$ can be computed as:

$$H_m(k\omega_0, n) = H_{m-1}(k\omega_0) + [H_{m+1}(k\omega_0) - H_{m-1}(k\omega_0)]\frac{n}{M-1}; \quad 0 \le n < M. \tag{3}$$

where m denotes the current frame index, and M is an integer that is a power of 2. The M set of interpolated spectral amplitudes are then compared with the original spectral amplitudes. The index for the best interpolated spectral amplitudes, $k_{best}$=k, which minimizes the MSE, $E_k$, is then coded and transmitted using only 3 bits.

Figure 3A:
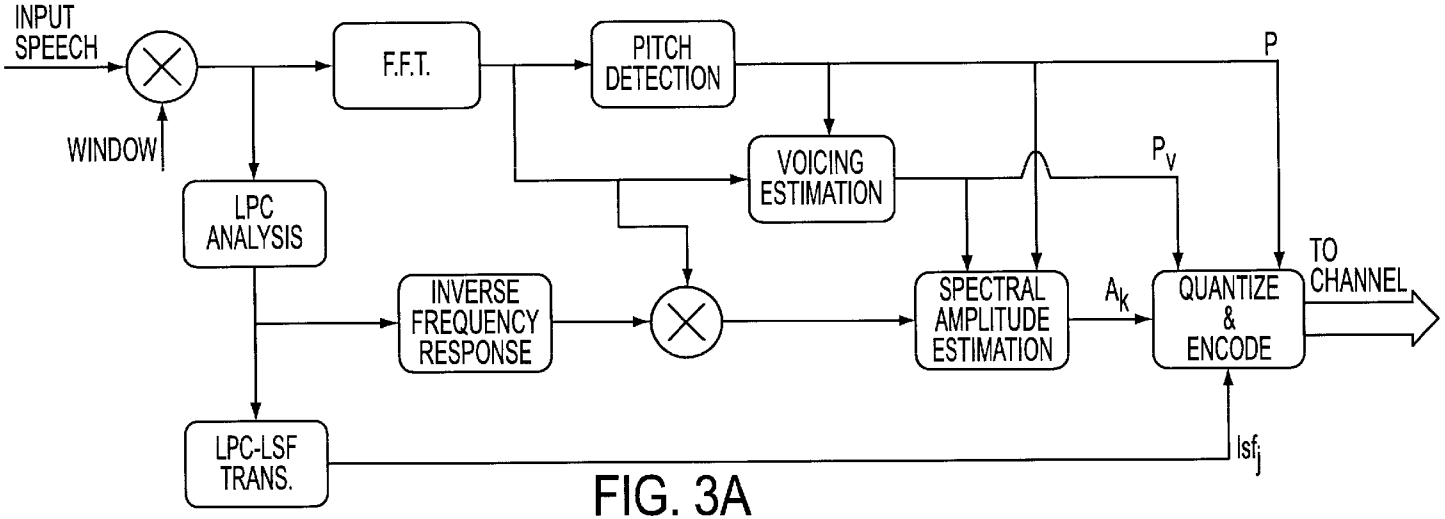
FIG. 3A is a diagram of a HE-LPC speech coder using the technique according to the present invention.
Figure 3B:
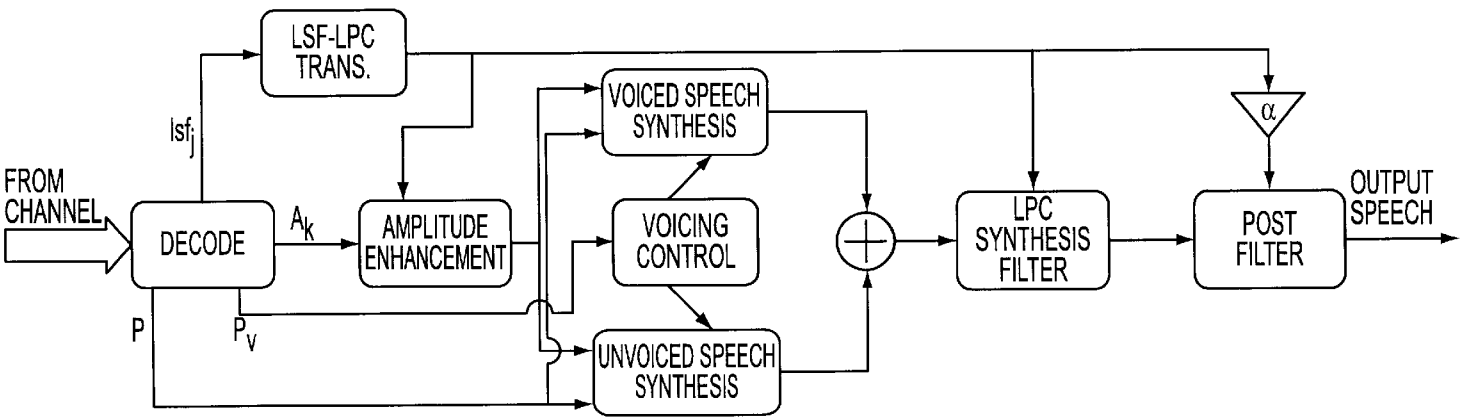
FIG. 3B is a diagram of a HE-LPC speech decoder using the technique according to the present invention.

The efficient quantization scheme for the speech spectral amplitudes according to this invention has been incorporated into the Harmonic Excitation Linear Predictive Coder (HE-LPC) described in S. Yeldener, A. M. Kondoz, and B. G. Evans "Multi-Band Linear Predictive Speech Coding at Very Low Bit Rates" IEEE Proc. Vis. Image and Signal Processing, October 1994, Vol. 141, No. 5, pp.289–295, and S. Yeldener, A. M. Kondoz, and B. G. Evans "A High Quality Speech Coding Algorithm Suitable for Future Inmarsat Systems" Proc. 7. European Signal Processing Conf. (EUSIPCO-94), Edinburgh, September 1994, pp. 407–410. The simplified block diagram of the HE-LPC coder is shown in FIG. 3. In this speech coder, the approach for representation of speech signals is to use a speech production model where speech is formed as the result of passing an excitation signal through a linear time varying LPC filter that models the characteristics of the speech spectrum. The LPC filter is represented by p LPC coefficients that are quantized in the form of Line Spectral Frequency (LSF) parameters. In this coder, the excitation signal is specified by the fundamental frequency, spectral amplitudes of the excitation spectrum and the voicing information. At the decoder, the voiced part of the excitation signal is determined as the sum of the sinusoidal harmonics. The unvoiced part of the excitation signal is generated by weighting the random noise spectrum with the original excitation spectrum for the frequency regions determined as unvoiced. The voiced and unvoiced excitation signals are then added together to form the final synthesized speech. At the output, a post-filter is used to further enhance the output speech quality. Informal listening tests have indicated that the HE-LPC algorithm produces very high quality speech for a variety of input clean and background noise conditions.

It will be appreciated that various changes and modifications can be made to the invention disclosed above without departing from the spirit and scope of the invention as defined in the appended claims.

What is claimed is:

1. A method of encoding speech signals, comprising grouping the speech signal into frame pairs each having first and second frames;

quantizing spectral amplitudes of said second frame; and quantizing spectral amplitudes of said first frame based on interpolation between spectral amplitudes of frames occurring before and after said first frame.

2. A method according to claim 1, wherein said frames before and after said first frame comprise said second framed a second frame of an immediately preceding frame pair.

3. A method according to claim 1, wherein said second quantizing step comprises converting variable dimension spectral amplitudes A(k) to a fixed dimension $H(\omega)$.

4. A method according to claim 3, wherein said converting step is performed in accordance with $$H(\omega) = A_k; \quad \left(\omega_k - \frac{\omega_0}{2}\right) \leq \omega < \left(\omega_k + \frac{\omega_0}{2}\right) \tag{1}$$

where $1 \leqq k \leqq L$; L is the total number of harmonics within a speech band of interest, $A_k$ and $\omega_k$ are the $k^{th}$ harmonic magnitude and frequency, respectively, $\omega_0$ is a fundamental frequency of a corresponding speech frame and $H(\omega)$ represents interpolated spectral amplitudes for an entire speech spectrum.

5. A method according to claim 3, wherein said second quantizing step further comprises sampling interpolated spectral amplitudes for frames before and after said first frame at harmonics of a fundamental frequency of said first frame to obtain first and second sets of harmonic samples; and interpolating between said first and second sets of harmonic samples to obtain a sets of interpolated harmonic amplitudes.

6. A method according to claim 5, wherein said second quantizing step further comprises comparing spectral amplitudes of the original speech frame with a selected one of said sets of interpolated harmonic amplitudes, and selecting an interpolated harmonic amplitude set in accordance with the comparison result.

7. A method according to claim 6, wherein said selecting step comprises minimizing a mean squared error between said harmonic amplitudes of said original speech frame and said interpolated harmonic amplitudes.

8. A method according to claim 7, wherein said first quantizing step comprises:

quantizing a spectral amplitude gain with n bits, where n is an integer.

dividing spectral harmonic amplitudes into first and second sets of harmonic amplitudes;

quantizing said first set of harmonic amplitudes with m bits, where m is an integer;

generating a difference measure between said first and second sets of harmonic amplitudes; and quantizing said difference measure with k bits, where k is an integer.

9. A method according to claim 8, wherein said first quantizing step comprises converting said first set of harmonic amplitudes to LOG and then to DCT domain before quantizing with m bits.

10. A method according to claim 9, further comprising quantizing said selected interpolated harmonic amplitudes with 1 bits, where 1 is an integer less than k.

11. A method according to claim 8, wherein k is less than m.

12. A method according to claim 1, wherein said first quantizing step comprises:

quantizing a spectral amplitude gain with n bits, where n is an integer.

dividing spectral harmonic amplitudes into first and second sets of harmonic amplitudes;

quantizing said first set of harmonic amplitudes with m bits, where m is an integer;

generating a difference measure between said first and second sets of harmonic amplitudes; and quantizing said difference measure with k bits, where k is an integer.

13. A method according to claim 12, wherein k is less than m.

14. A method according to claim 1, wherein said step of quantizing spectral amplitudes of said second frame is not dependent on spectral amplitude values in frames both before and after said second frame.

* * * * *